US008348465B2

(12) United States Patent
Schrimmer et al.

(10) Patent No.: US 8,348,465 B2
(45) Date of Patent: Jan. 8, 2013

(54) SAFETY GLOW STICK WITH FLASHLIGHT

(75) Inventors: Jeffrey D. Schrimmer, Highland Park, IL (US); Leon M. Levy, Chicago, IL (US); Mitchell J. Weinstein, Deerfield, IL (US)

(73) Assignee: I PEE Holding LLC, Vernon Hills, IL (US)

( * ) Notice: Subject to any disclaimer, the term of this patent is extended or adjusted under 35 U.S.C. 154(b) by 0 days.

(21) Appl. No.: 13/292,917

(22) Filed: Nov. 9, 2011

(65) Prior Publication Data

US 2012/0257377 A1 Oct. 11, 2012

Related U.S. Application Data

(60) Provisional application No. 61/472,042, filed on Apr. 5, 2011.

(51) Int. Cl.
*F21V 21/00* (2006.01)

(52) U.S. Cl. ..... 362/249.13; 362/120; 362/184; 362/225; 362/249.05

(58) Field of Classification Search ..... 362/119, 362/120, 158, 217.01, 227, 202, 205, 249.01, 362/249.02, 249.05, 249.12, 249.13
See application file for complete search history.

(56) References Cited

U.S. PATENT DOCUMENTS

| | | | | |
|---|---|---|---|---|
| 3,774,023 | A * | 11/1973 | Cobarg et al. | 362/183 |
| 6,573,659 | B2 * | 6/2003 | Toma et al. | 315/149 |
| D526,689 | S * | 8/2006 | Marshall et al. | D21/473 |
| 7,126,484 | B1 * | 10/2006 | Luquire | 340/574 |
| 7,683,790 | B2 * | 3/2010 | Luquire | 340/574 |
| 7,845,820 | B2 | 12/2010 | Bertken | |
| 8,113,682 | B2 | 2/2012 | Bertken | |
| 2011/0044034 | A1 | 2/2011 | Bertken | |

* cited by examiner

*Primary Examiner* — John A Ward
(74) *Attorney, Agent, or Firm* — Levenfeld Pearlstein, LLC

(57) ABSTRACT

A glow stick includes a housing, a lighting assembly mounted within the housing, having at least two light sources, at least one power source, at least one switch and circuitry for controlling the at least two light sources. An elongated body is mounted to the housing and is formed from a material that is transparent or translucent to light transmission. One of the light sources is mounted within the housing to provide a flashlight that is mounted to the housing at an angle between 0 and 180 degrees and the other light source is directed into the elongated body to illuminate the elongated body so that light is visible therefrom. The light source for the flashlight is switchable between a constant on and a constant off state and the light source illuminating the body is switchable among a constant on state, a constant off state and an intermittent state. The flashlight light source and the body light source are operable independently of one another.

24 Claims, 11 Drawing Sheets

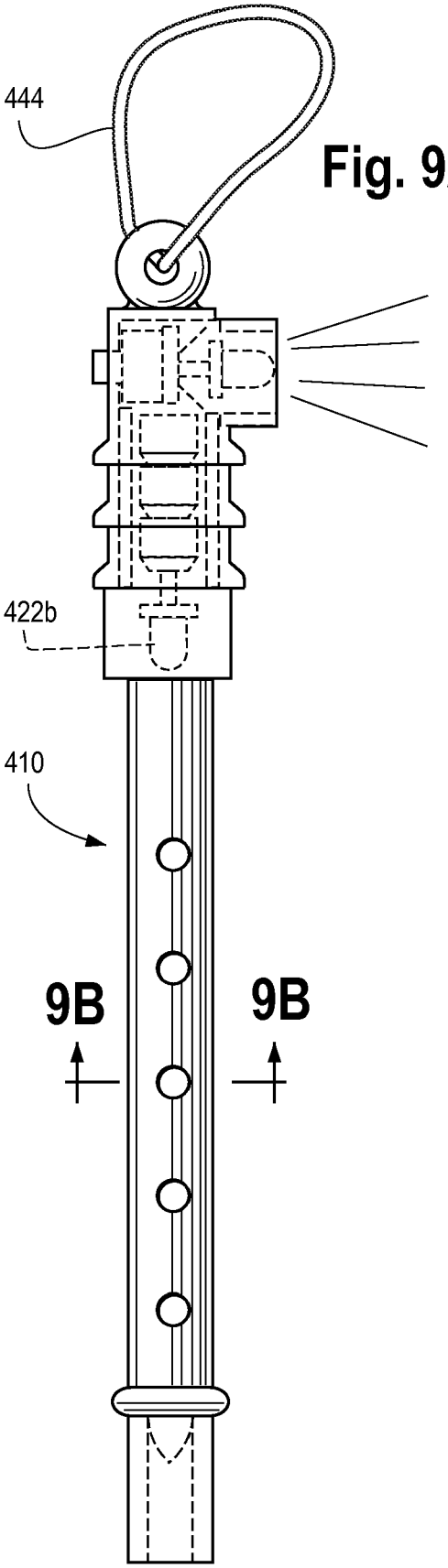
Fig. 9A
Fig. 9B
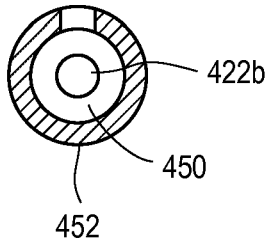

SAFETY GLOW STICK WITH FLASHLIGHT

CROSS-REFERENCE TO RELATED APPLICATION DATA

This application claims the benefit of priority of Provisional Patent Application Ser. No. 61/472,042, filed Apr. 5, 2011, the disclosure of which is incorporated herein by reference.

BACKGROUND

This disclosure pertains to a safety glow stick. More particularly, the present disclosure pertains to a safety glow stick with a flashlight portion for readily illuminating a desired area.

Safety glow sticks are known. One such stick includes a longitudinally directed flashlight positioned at one end with an illuminated, colored, elongated glowing portion at an opposite end. The flashlight and glowing portions are coaxially disposed and are both illuminated by LEDs. The LEDs are contained within a module that includes the LEDs, controls and a power source. The module is located within a central housing portion. The control circuitry/system is configured such that either the flashlight or the glowing portion are illuminated, but not both simultaneously.

There are drawbacks to such known devices. For example, the flashlight is directed coaxially or longitudinally out of the end of the device. While this may be appropriate for certain uses, it is not necessarily the most ergonomic configuration or desirable for other uses. In addition, the inability to illuminate (use) the flashlight while the glow portion is illuminated is also overly limiting.

Accordingly, there is a need for a safety glow stick that permits easy, comfortable use, and permits the use of both the flashlight portion and the glowing portion simultaneously.

BRIEF DESCRIPTION OF THE DRAWINGS

FIGS. 9A and 9B are a side and partial cross-sectional views of still another alternate embodiment of the glow stick having a flute incorporated into the body thereof;

DETAILED DESCRIPTION

Figure 1:
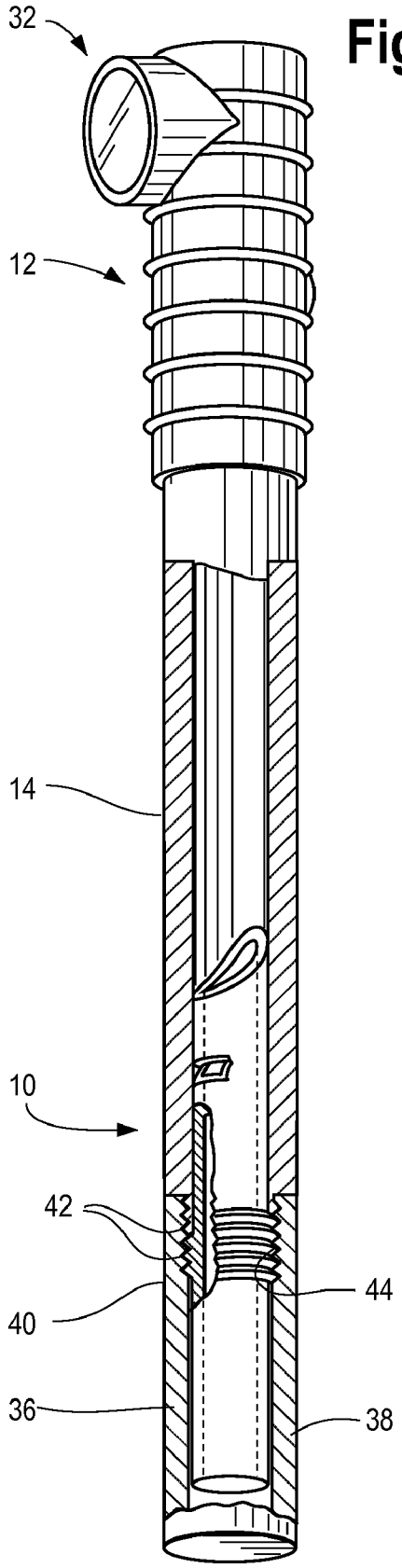
FIG. 1 is a perspective illustration of an embodiment of a safety glow stick.

While the present glow stick is susceptible of embodiment in various forms, there is shown in the drawings and will hereinafter be described various embodiments with the understanding that the present disclosure is to be considered an exemplification of the glow stick and is not intended to be limited to the specific embodiments illustrated.

Figure 2:
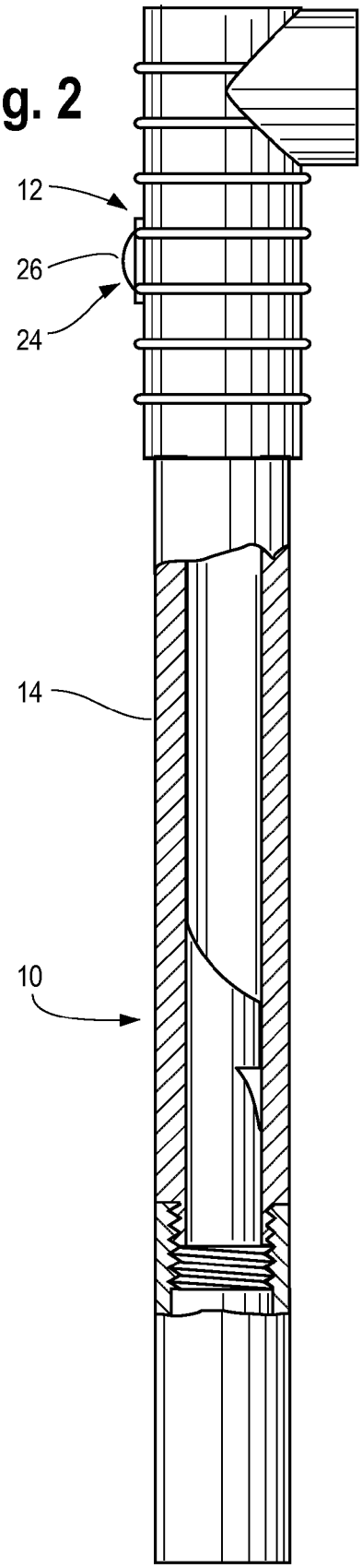
FIG. 2 is a side view of the glow stick.
Figure 3:
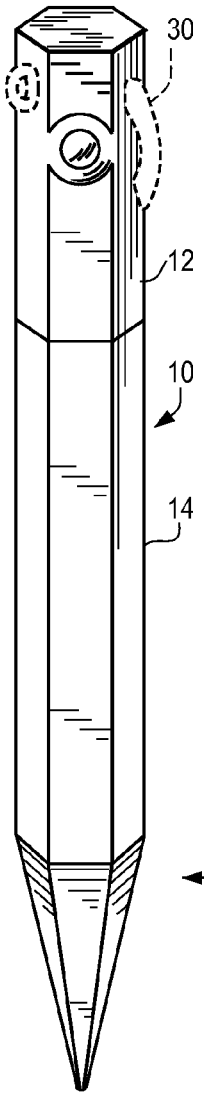
FIG. 3 is a perspective illustration of another embodiment of the glow stick.
Figure 4:
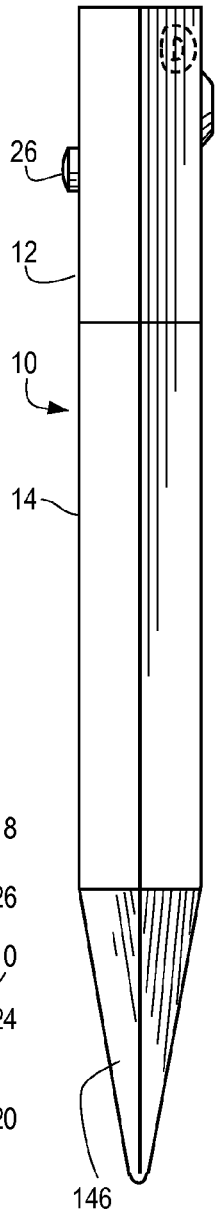
FIG. 4 is a side view of the glow stick of FIG. 3.
Figure 5:
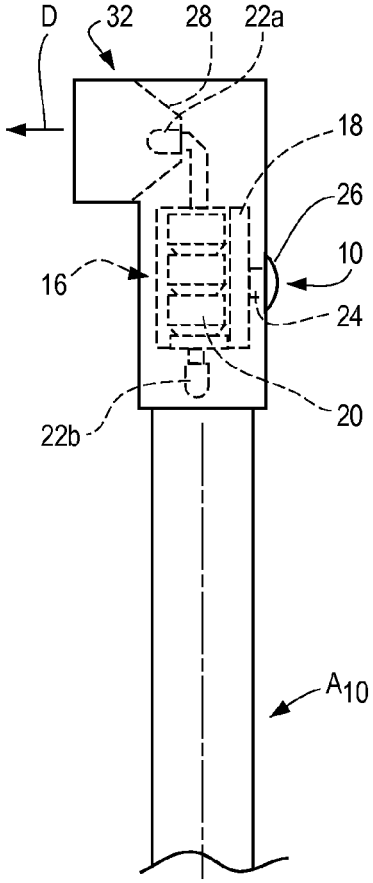
FIG. 5 is a partially broken away view showing the interior of the of glow stick.

Referring now to the figures and in particular to FIGS. 1-2 and 5, there is shown an embodiment of a safety glow stick 10. The stick includes a housing 12 and an elongated body portion 14 formed from a transparent or translucent material. The body portion is formed so as to allow light from inside of the body to be perceived outside of the body.

The housing includes a lighting assembly 16 having circuitry (as on a printed circuit board or the like 18), one or more power sources 20, such as a battery or batteries, two or more light sources 22*a*, 22*b* (collectively 22), such as lamps, LEDs or the like, and a controller or switch 24. In a preferred embodiment, the light sources are LEDs. It will be appreciated that LEDs draw less power than traditional (e.g., incandescent lamps) and are thus preferable in a small, hand-held device. In a preferred embodiment, a flexible membrane 26 is positioned over the switch, and a reflector 28 is positioned about one of the light sources 22*a*.

One or more of the LEDs, for example, LED 22*a*, functions as a flashlight, to provide area or spot illumination. The other (one or more) LEDs 22*b*, provides illumination into the body to provide a glow effect of the body—as provided above, the body is formed from a transparent or translucent material so that light that shines into the body will effectively illuminate the body.

The body LEDs and/or the body can be colored, for example, red, to provide serves as a lighting or locating beacon or the like. The body can also include a pocket clip 30 (see, e.g., FIG. 6) to permit the device to be held in and secured to a user's pocket or shirt collar to permit hands-free use, or to permit the light to be secured to or hung from, for example, a cord or the like.

As illustrated in the embodiments of FIGS. 1-2 and 3-4, the flashlight portion 32 is mounted such that the direction of illumination D is at an angle $\alpha$ to a longitudinal axis $A_{12}$ of the glow stick body 12. In this manner, the glow stick can be held by a user in such a manner that the user's hand is in a more comfortable position, with the wrist in a natural position or orientation, rather than bent at an angle. This also provides a more ergonomic feel, for example, when using the flashlight 32 to search an area or for those with lesser manual dexterity.

Figure 6:
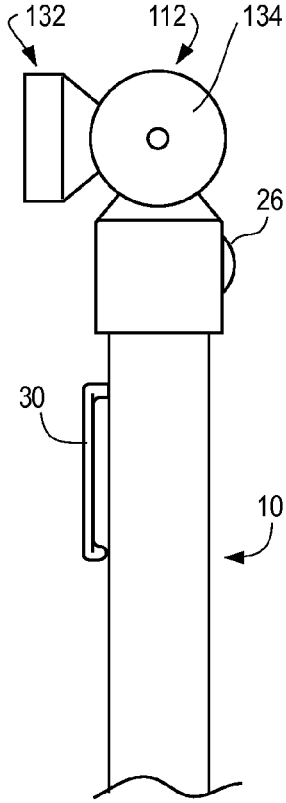
FIG. 6 is another embodiment of the glow stick showing a hinged portion to allow for varying the angle at which the flashlight is used.

In the illustrated embodiments, the angle $\alpha$ flashlight direction of illumination is about 90 degrees to the longitudinal axis $A_{12}$. However, a range of angles between but exclusive 0 of and 180 degrees is contemplated. Optionally, as seen in FIG. 6, the device can be provided with a flashlight portion 132 that is mounted by a hinged joint 134 to provide a variable angle relative to the longitudinal axis at which the flashlight can be used.

The glow stick also permits use of the flashlight simultaneously with the glow portion. In one contemplated configuration (programming mode), the stick can be used in flashlight mode only, in glow mode (flashing or constant illumination) only, and in flashlight mode simultaneously with glow mode (flashing or constant illumination).

As seen in FIGS. 1-2, the glow stick optionally includes a whistle 36. One embodiment includes the whistle mounted within a cap 38 that is mounted to an end 40 of the elongated body. The cap can be removed and the whistle used independently of the glow stick. It is contemplated that the cap is joined to the body by a threaded connection 42 and that the whistle portion is joined to the cap by a second threaded connection 44.

It will be appreciated that the glow stick can take various shapes. For example, in addition to the cylindrical shape of FIGS. 1-2, the stick can have an angled cross-section such as the hexagonal shape of FIGS. 3-4. The glow stick can also be configured with a pointed or tapered end 146 to, for example, facilitate securing the stick in the ground or other surface. Such other shapes and mounting configurations, and others, are contemplated, and are within the scope of the present disclosure.

Figure 7:
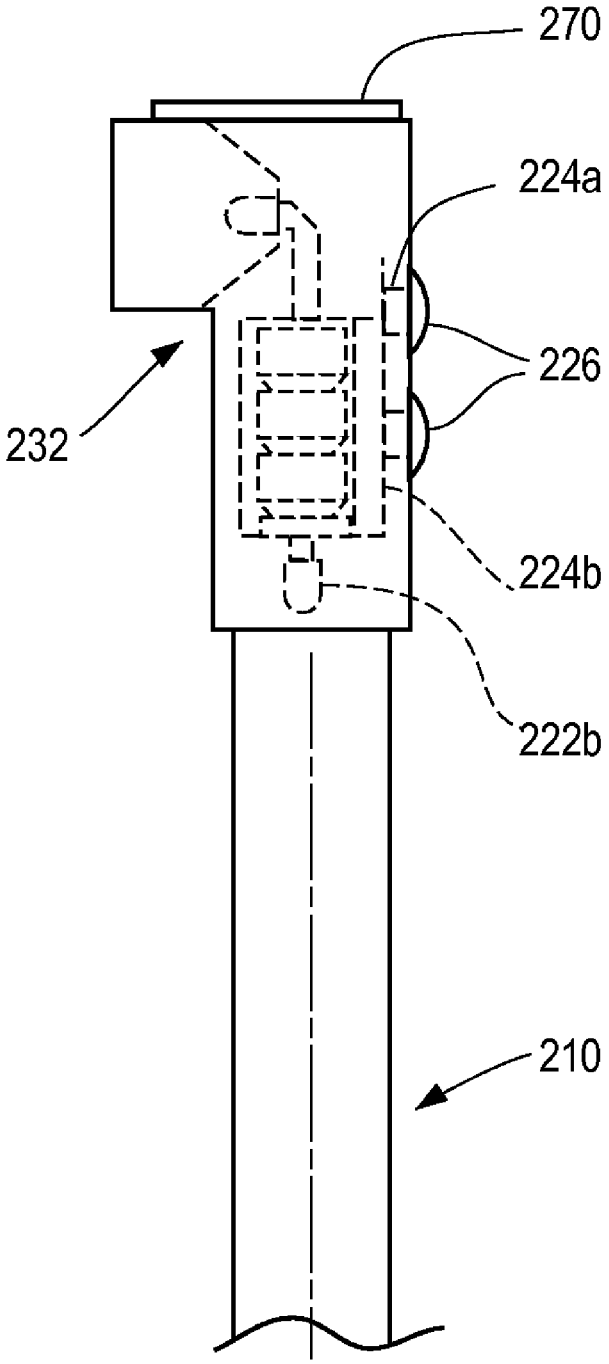
FIG. 7 is a side view of an alternate embodiment of the safety glow stick.

An alternate embodiment of the light stick 210 is illustrated in FIG. 7 that includes two switches 224*a*, 224*b*. The switches 224*a*, 224*b* are independent of one another, one of which 224*a* controls the flashlight portion 232 and the other of which 224*b* controls the body illumination LED 222*b*. Each switch 224*a*, 224*b* can be provided with a flexible membrane 226 positioned over the switch 224*a*, 224*b* to provide for protection from water, dust, dirt and the like.

Figure 8:
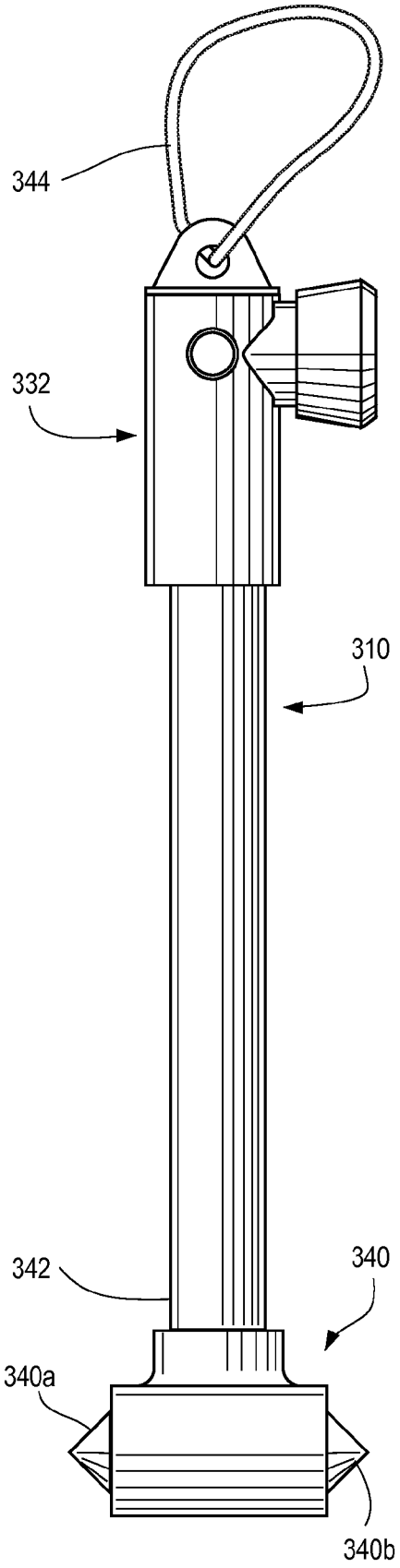
FIG. 8 is a side view of still another alternate embodiment of the glow stick having a hammer member at an end thereof.

Still another embodiment of the glow stick 310 is illustrated in FIG. 8. This embodiment includes a striking member 340, such as a hammer, mounted to an end 342 of the body 314, opposite of the flashlight portion 332. The hammer 340 can have opposing heads 340*a*, 340*b* that are pointed (as illustrated) or flat (not shown) to, for example, facilitate breaking a window, such as a vehicle window, to gain access to the interior of the vehicle in emergency situations. The flashlight portion 332 can optionally include a cord 344 to secure the light to, for example, a belt or the like. Those skilled in the art will appreciate other tools or implements the can be incorporated into one or both ends of the glow stick 310.

Yet another embodiment of the glow stick 410 is illustrated in FIGS. 9A and 9B. This embodiment also includes a cord 444 to, for example, hang the glow stick 410. This embodiment of the glow stick 410 also includes an aerophone or flute 440 incorporated into the body 414 of the glow stick 410. The illuminating element 422*b* in the glow stick body 414 can be carried in an internal chamber 450 and the flute or sound producing portion carried in an outer chamber 452 so that light can be seen as the flute is played.

Figure 10:
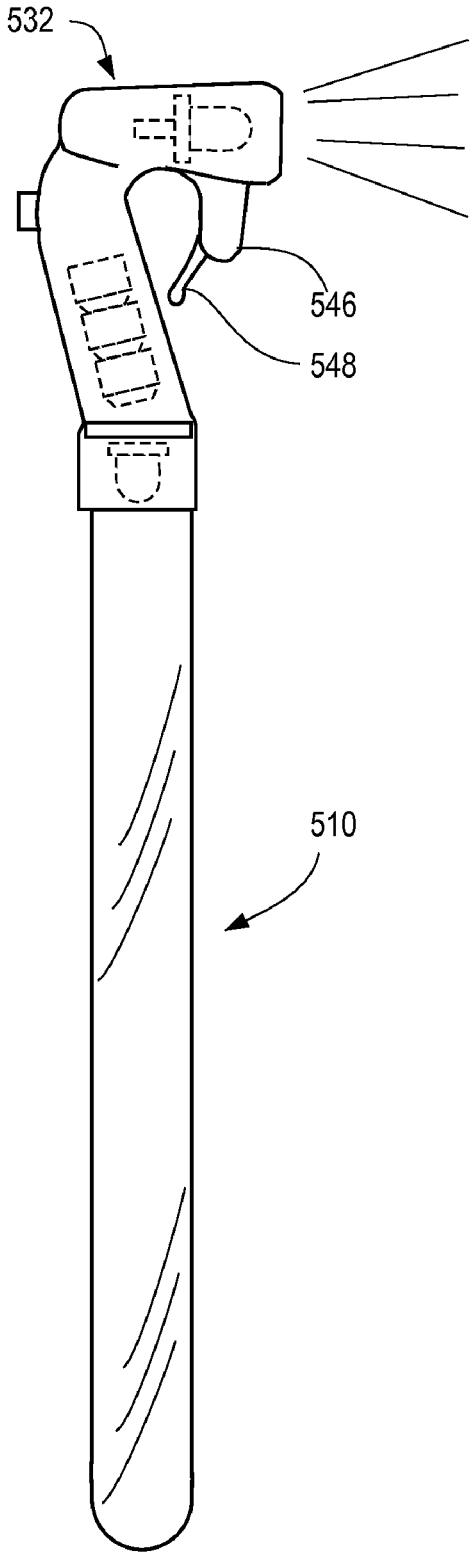
FIG. 10 is a side view of still another alternate embodiment of the glow stick having an integral hang hook.

FIG. 10 illustrates still another embodiment of the glow stick 510 that incorporates a hang hook 546 into the head portion 532 of the glow stick 510. The hang portion 546 can be provided by an angled housing or head 532 (angled relative to the body 514) and a hook portion 546 formed in the head 532. The flashlight is incorporated into the head 532 and forms part of the hook 546. A retaining member 548 can be formed as part of, or mounted to the head 546 so that the glow stick 510 is maintained in place once secured to an object. The retaining member 548 can be formed as a flexible member or can be mounted by a spring (not shown) to facilitate releasing the glow stick 510 from the item to which it is secured.

Figure 11:
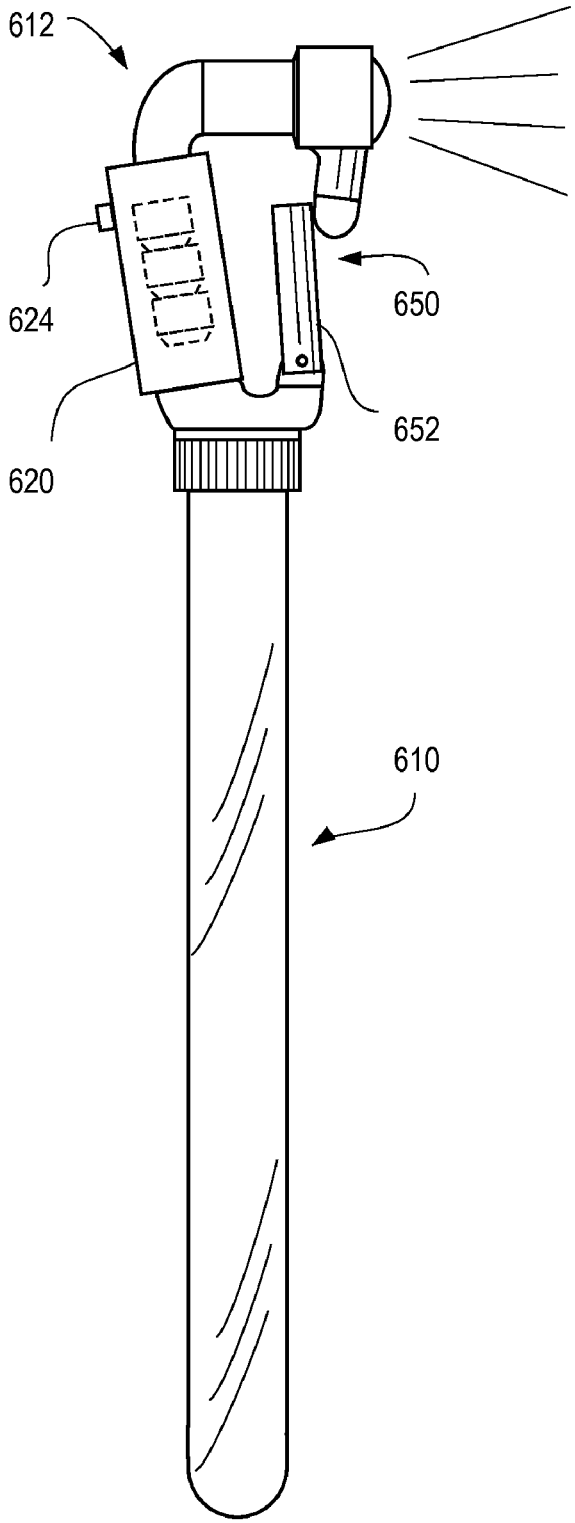
FIG. 11 is a side view of yet another alternate embodiment of the glow stick having an integral carabiner.

Still another embodiment of the glow stick 610 is illustrated in FIG. 11. In this embodiment, the head portion 612 is formed as a carabiner 650. The power source 620 and or switches 624 can be carried in a leg of the carabiner 650 so that the carabiner 650 is incorporated within the structure of the glow stick head 632. A latch 652 is included to retain the glow stick 610 retained on an item to which it is secured.

Figure 12:
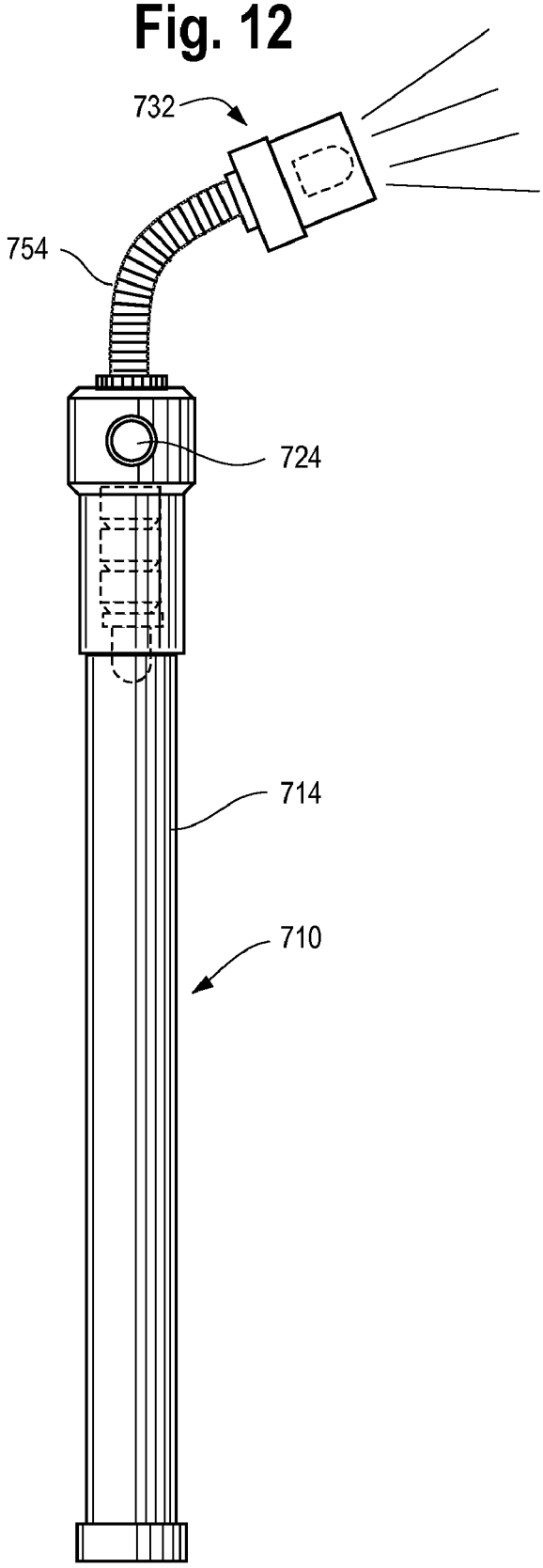
FIG. 12 is a side view of yet another alternate embodiment of the glow stick having a flexible neck portion with a flashlight member mounted thereto.

Yet another embodiment of the glow stick 710 is illustrated in FIG. 12, in which the flashlight portion 732 is mounted to the glow stick 710 by a flexible neck 754. In this manner, the flashlight portion 732 can be positioned to illuminate other than only longitudinal relative to the body 714 of the glow stick 710. The flexible neck 754 can include a wire or the like (not shown) so that the flashlight portion 732 will remain in a position to which the neck 754 is bent. Electrical connectors can be provided in the neck 754 so that the control (switch 724) for the flashlight portion 732 can be located on the body 714 of the glow stick 710. Alternately, the switch for the flashlight portion 732 can be mounted directly in the flashlight portion 732.

Figure 13:
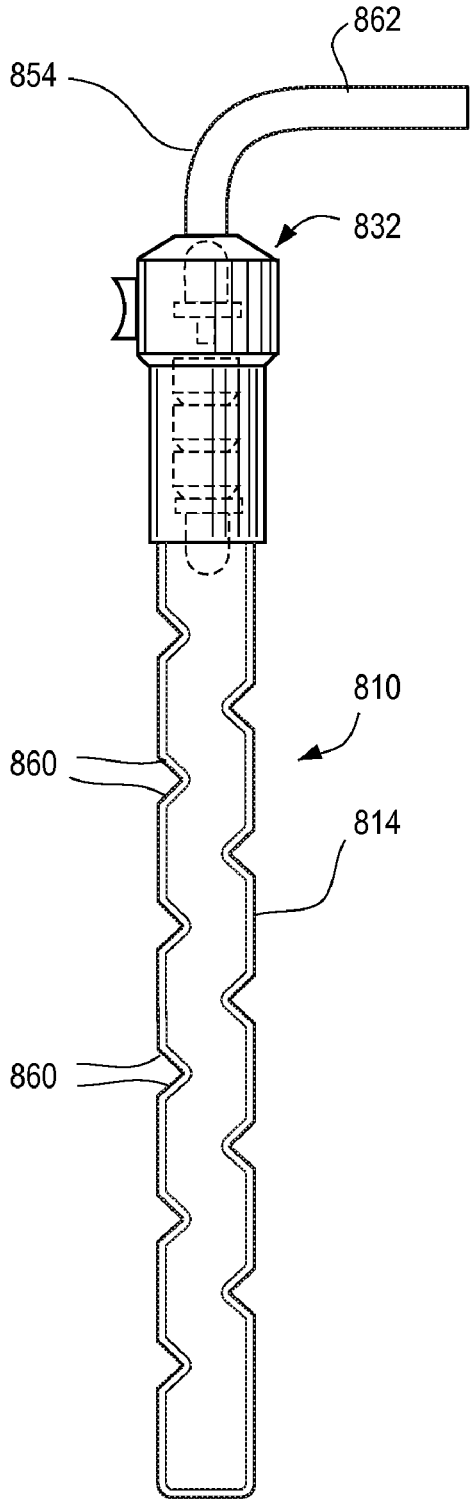
FIG. 13 is a side view of still another alternate embodiment of the glow stick having facets or angled surfaces in the body thereof and having a flexible neck and/or light tube extending therefrom.

Still another embodiment of the glow stick 810 is illustrated in FIG. 13 in which the body 814 of the glow stick 810 includes facets or angled surfaces 860 to provide a novel illuminated effect. The facets 860 can be equally spaced from one another or can be formed at different, random locations and angles on the body 814. The flashlight portion 832 can optionally include a light tube 862 extending from the body, from which light can be emitted, using, for example, fiber optics, or the flashlight portion 832 can include a flexible neck 854, such as that illustrated in the embodiment illustrated in FIG. 12.

Figure 14:
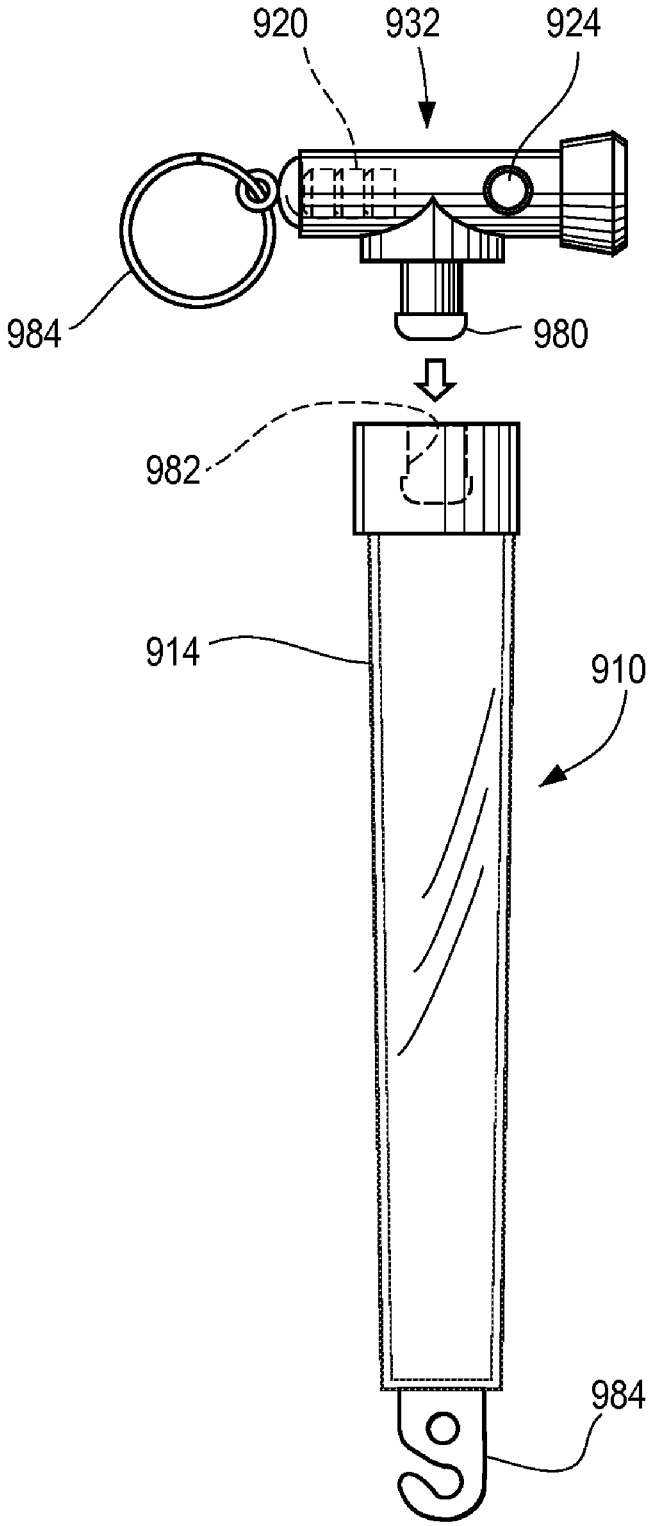
FIG. 14 is a side view of yet another alternate embodiment of the glow stick having a hammer member at a removable flashlight module.

Yet another embodiment of the glow stick 910 is illustrated in FIG. 14 in which the flashlight portion 932 can be removably mounted to the body 914 by a removable fitting 980, for example, a flexible barb or other fitting that permits plugging the flashlight portion 932 into the body 914. An opening 982 in the body 914 accommodates the plug fitting 980 and allows the flashlight portion 932 to swivel within the opening 982. The flashlight portion 932 can include power and controls (e.g., batteries 920 and a switch 924) independent of the body 914 glow portion so that it can be removed and used separate and apart from the body 914 glow portion. Hand hooks 984, rings and like can be included on one of both portions (e.g., the body and the flashlight portion) to permit separate use and mounting of the body 914 glow portion and the flashlight 932.

Those skilled in the art will appreciate that power can be provided to both the body glow portion as well as the flashlight by a variety of sources. For example, conventional and/or rechargeable batteries (see, e.g., 20 in FIG. 5) can be used to provide power. It is also contemplated that solar cells/collectors (for example, see 270 in FIG. 7) can be used to provide power as well as to collect/store power for later use, such as through the use of rechargeable batteries. Conventional line or AC power can also be used and can be used in conjunction with batteries for power storage.

It will also be appreciated by those skilled in the art that the different features of the various embodiments can be combined with one another in the design and configuration of a glow stick, and that such combinations of different/various features are within the scope and spirit of the present disclosure.

From the foregoing it will be observed that numerous modifications and variations can be effectuated without departing from the true spirit and scope of the novel concepts of the present disclosure. It is to be understood that no limitation with respect to the specific embodiments illustrated is intended or should be inferred. The disclosure is intended to cover by the appended claims all such modifications as fall within the scope of the claims.

What is claimed is:

1. A glow stick, comprising:

a housing;

a lighting assembly mounted within the housing, the lighting assembly including at least two light sources, at least one power source, two switches, one of the switches configured to control one of the at least two light source and the other switch configured to control another of the at least two light sources, and circuitry for controlling the at least two light sources;

an elongated body mounted to the housing, the elongated body formed from a material that is transparent or translucent to light transmission, the elongated body defining a longitudinal axis, wherein one of the light sources is mounted within the housing to provide a flashlight, the flashlight mounted to the housing at an angle of about 90 degrees relative to the longitudinal axis, and wherein the other of the light sources is directed into the elongated body generally along the longitudinal axis to illuminate the elongated body so that light is visible therefrom, and wherein the light source for the flashlight is switchable between a constant on and a constant off state and the light source illuminating the body is switchable among a constant on state, a constant off state and an intermittent state and wherein the flashlight light source and the body light source are operable independently of one another.

2. The glow stick of claim 1 wherein the light sources are LEDs.

3. The glow stick of claim 1 including a striking member mounted to the elongated body opposite of the housing.

4. The glow stick of claim 3 wherein the striking member is a hammer.

5. The glow stick of claim 1 wherein the elongated body is an aerophone, and wherein the light source illuminating the body is illuminatable independent of playing of the aerophone.

6. The glow stick of claim 5 wherein the light source illuminating the body illuminates a body of the aerophone.

7. The glow stick of claim 1 wherein the housing is formed having a hook, and wherein the flashlight is formed in a body of the hook.

8. The glow stick of claim 1 wherein the housing is formed as a carabiner, and wherein the flashlight is formed in a body of the carabiner.

9. The glow stick of claim 1 wherein the elongated body is formed with facets therein.

10. The glow stick of claim 1 wherein the housing is removably mounted to the elongated body.

11. The glow stick of claim 10 wherein the flashlight potion includes a light source, a power source, a switch and circuitry independent of the body glow portion and wherein the flashlight portion is operable independently of the light source illuminating the body portion.

12. The glow stick of claim 1 wherein the light source illuminating the body is colored other than white.

13. The glow stick of claim 1 including a clip on the body.

14. The glow stick of claim 1 including a whistle mountable to the body.

15. The glow stick of claim 1 including a tapered end.

16. The glow stick of claim 1 wherein the power source is one or more rechargeable batteries.

17. The glow stick of claim 1 including a solar collector.

18. The glow stick of claim 17 wherein the power source is one or more rechargeable batteries and wherein the solar collector is operably connected to the one or more rechargeable batteries.

19. A glow stick, comprising:

a housing;

a lighting assembly mounted within the housing, the lighting assembly including at least two light sources, at least one power source, two switches, one of the switches configured to control one of the at least two light source and the other switch configured to control another of the at least two light sources, and circuitry for controlling the at least two light sources;

an elongated body mounted to the housing, the elongated body formed from a material that is transparent or translucent to light transmission, the elongated body defining a longitudinal axis, wherein one of the light sources is mounted within the housing to provide a flashlight and the other of the light sources is directed into the elongated body generally along the longitudinal axis to illuminate the elongated body so that light is visible therefrom, the flashlight light source mounted within the housing to provide a flashlight having a variable angle of between and exclusive of 0 and 180 degrees relative to the body axis, and wherein the light source for the flashlight is switchable between a constant on and a constant off state and the light source illuminating the body is switchable among a constant on state, a constant off state and an intermittent state and wherein the flashlight light source and the body light source are operable independently of one another.

20. The glow stick of claim 19 wherein the flashlight is mounted to the body by a neck portion.

21. The glow stick of claim 20 wherein the neck portion is flexible.

22. The glow stick of claim 21 including a shape retaining element in the neck portion to permit bending the neck portion and retaining the neck portion in a desired shape.

23. The glow stick of claim 20 wherein the neck portion is formed as a light emitting element.

24. The glow stick of claim 19 wherein the flashlight light source is mounted within the housing by a hinged joint.

* * * * *